US007252582B2

(12) United States Patent
Renteln

(10) Patent No.: US 7,252,582 B2
(45) Date of Patent: Aug. 7, 2007

(54) OPTIMIZED GROOVING STRUCTURE FOR A CMP POLISHING PAD

(75) Inventor: Peter Renteln, San Ramon, CA (US)

(73) Assignee: JH Rhodes Company, Inc., Tempe, AZ (US)

( * ) Notice: Subject to any disclaimer, the term of this patent is extended or adjusted under 35 U.S.C. 154(b) by 100 days.

(21) Appl. No.: 10/924,835

(22) Filed: Aug. 25, 2004

(65) Prior Publication Data

US 2006/0046626 A1 Mar. 2, 2006

(51) Int. Cl.
*B24D 11/00* (2006.01)
*B24B 7/00* (2006.01)

(52) U.S. Cl. ..... 451/527; 451/533; 451/550

(58) Field of Classification Search ..... 451/527, 451/533, 550
See application file for complete search history.

(56) References Cited

U.S. PATENT DOCUMENTS 4,142,334 A * 3/1979 Kirsch et al. ..... 451/539
5,489,233 A 2/1996 Cook
5,725,420 A * 3/1998 Torii ..... 451/285
5,921,855 A 7/1999 Osterheld
5,984,769 A 11/1999 Bennett
6,019,666 A * 2/2000 Roberts et al. ..... 451/36
6,241,596 B1 6/2001 Osterheld
6,254,456 B1 * 7/2001 Kirchner et al. ..... 451/41
6,409,581 B1 * 6/2002 Robinson et al. ..... 451/59
6,439,989 B1 8/2002 Reinhardt
6,645,061 B1 11/2003 Bennett
6,688,957 B2 * 2/2004 Tolles ..... 451/532
6,729,950 B2 * 5/2004 Park et al. ..... 451/528
6,736,709 B1 5/2004 James et al.
6,749,485 B1 * 6/2004 James et al. ..... 451/41
6,913,517 B2 * 7/2005 Prasad ..... 451/41
7,017,246 B2 * 3/2006 Suzuki ..... 29/50

FOREIGN PATENT DOCUMENTS

EP 1 211 023 A1 5/2002
EP 1 369 204 A1 12/2003

* cited by examiner

*Primary Examiner*—Lee D. Wilson
*Assistant Examiner*—Alvin J Grant
(74) *Attorney, Agent, or Firm*—Snell & Wilmer L.L.P.

(57) ABSTRACT

A polishing pad for a chemical mechanical polishing has a body rotatable in a predetermined direction and having a working surface, the working surface being provided with grooves, the grooves being formed so that over the course of a single revolution of the pad said grooves extend in all directions in the plane of the working surface. Such an arrangement of grooves is the optimum configuration for CMP, especially copper CMP.

18 Claims, 2 Drawing Sheets

OPTIMIZED GROOVING STRUCTURE FOR A CMP POLISHING PAD

BACKGROUND OF THE INVENTION

The present invention generally relates to polishing pads, in particular for chemical-mechanical polishing (CMP) with the use of a slurry. CMP is a process step in the semiconductor fabrication sequence that has generally become an integral part of the manufacture of semiconductor wafers. The process is used in a variety of applications in the semiconductor fabrication sequence. A summary of the different applications would include that which is referred to as "oxide" or "ILD/PMD", "STI", "copper", "barrier", "poly" and "tungsten", the terms generally indicating the material that is being removed. The common theme relating all of these applications is that CMP is required to expediently remove material and planarize the surface, while leaving it defect and contamination free. These applications generally require the use of different slurries, and their mechanism of removal is therefore also generally different. Because of that, the optimal condition of each of the applications tends to be different as well.

The manufacture of integrated circuits consists of a large number of steps performed in sequence and can be generally described by one of two process flows, where one flow is often referred to as "Aluminum back end" and the other is often referred to as "copper back end". Of these two, the aluminum process is technologically older, while the copper process is newer. A general description of the aluminum back end is as follows:

Starting with bare silicon, the transistors are outlined on the wafer and are electrically insulated from each other by filling trenches etched in the silicon with an oxide, usually $SiO_2$. The oxide overburden is removed and planarized using an STI process. The fabrication of the transistors is completed and they are covered with another $SiO_2$ layer, often a doped oxide. This layer is planarized using a PMD process. Vias are etched and filled with tungsten to make contact to the transistors. The overburden is removed and the tungsten planarized using a tungsten process. Aluminum is deposited, patterned, and etched to create conductive interconnect lines. Subsequent alternating oxide and aluminum layers are created, where in each case the oxide layer is planarized using an ILD process. This is continued until the completion of all the layers.

A general description of the copper back end is as follows: Starting with bare silicon, the transistors are outlined on the wafer and are electrically insulated from each other by filling trenches etched in the silicon with an oxide, usually $SiO_2$. The oxide overburden is removed and planarized using an STI process. The fabrication of the transistors is completed, often using a process which is the inverse of the method used to make the gates typically used in the aluminum process. The oxide is etched and filled with polysilicon. The overburden is removed and planarized using a poly process. An oxide layer is deposited over the gates and often etched for a tungsten deposition known as Local Interconnect. The CMP process here would also be a tungsten process. Another oxide layer is deposited and channels and vias etched in the oxide, which are filled with copper. The copper is then polished using a copper process. Subsequent layers of oxide and copper are deposited, but in this case the CMP is applied to the copper layer rather than the oxide layer. The barrier is a material which is deposited below the copper so as to prevent the copper from diffusing into the oxide and into the devices. This barrier material is typically Ti or TiN, and it is removed by a barrier CMP step which follows the copper step.

In any of these CMP processes, the silicon substrate is forcibly placed in direct contact with a moving polishing pad. A wafer carrier applies pressure against the backside of the substrate, usually while simultaneously forcibly applying rotation. During this process a slurry is made available, and is generally carried between the wafer and the pad by the motion of the pad. The elements contained in the slurry are chosen by the CMP application. In general, slurries that are designed to remove insulating materials consist of water, an abrasive and an alkali formulation designed to "hydrolyze" the insulating material. Copper slurries on the other hand, tend consist of water, an abrasive, an oxidizing agent, a complexing agent, and a chemical to passify the surface. A typical slurry often has very low removal rate on a material it was not designed to remove.

The presence of grooves is instrumental in delivering the slurry to the wafer-pad interface, where it is required for the process to be carried out. The slurry enables the polishing process to occur by chemically reacting with the material which is being polished. The pattern, pitch, width and depth of these grooves are generally known to be an important part of the process. Grooves are discussed in various patents. See, for example, U.S. Pat. Nos.: 6,645,061; 6,439,989; 6,241,596; 5,984,769; 5,921,855 and 5,489,233. The patterns recognized include substantially circular, spiral, multiple spiral, wavy concentric, off-center concentric, disjoint concentric, oscillating radial, arcuate, x (straight and parallel), x-y, grooves of different pitch and combinations thereof, deep and shallow, wide and narrow grooves and combinations thereof. Additional patterns include fractal, perforated, hexagons, triangles and tire-tread. The groove profile may be rectangular with straight side-walls or the groove cross-section may be "V"-shaped, "U"-shaped, triangular, or tetragonal. Also the groove design may change across the pad surface.

The purpose of grooves on CMP pads can be summarized as follows:

1. Grooves help prevent the wafer from hydroplaning. If the pad is smooth and without channels or perforations, a continuous boundary layer of slurry can form at the pad wafer interface, preventing intimate pad-wafer contact and significantly reducing removal rate.
2. Grooves ensure the transport of slurry to the center of the wafer. Because of the motion of the pad, slurry tends to reach the edges of the wafer without the need for grooves. But a plethora of data shows that the absence of grooves causes the rate to drop toward the center of the wafer, implying the center has been starved of slurry.
3. Grooves reduce the area of contact between the pad and the wafer, increasing the local pressure. This is not so important for the wafer where the mechanisms provided by most commercial CMP tools is adequate to deliver the desired downforce and thus pressure, but is very useful for conditioning, a process of forcibly applying a diamond or abrasive studded disk against the moving pad to create roughness. The mechanism for this action provided by most commercial CMP tools is often inadequate compared to what is desired. By reducing the pad/conditioner area of contact, a given provided force results in a higher local pressure.
4. Grooves provide air under the pad so as to avoid the phenomenon known as "stiction". During the course of polishing, the surface of the pad in the wafer track (the donut shaped area created by the rotation of the pad) tends to become smoother, even in the face of conditioning. Together with the help of the slurry, the wafer and pad tend to "mate", i.e. form a very close contact at all places. This results in a well known sticking force, which causes the requirement of higher force to lift the wafer off the pad surface after the end of the polishing process. This higher force can easily exceed the attraction force keeping the wafer attached to the carrier and result in the wafer coming loose and being left on the pad. This undesirable effect is strongly mitigated by the effect of grooves allowing air to enter under the wafer, equalizing the pressure and alleviating the vacuum effect.

5. Finally, and most important to the process of metal polishing, grooves act as channels for the removal of by-product and polishing debris from the pad surface. While for oxide polishing, a build-up of debris increases the likelihood of scratches and other defects, for metal polishing, the removal of by-products of the reaction is essential to proper continuation of the reaction. Without the removal of these by-products, the reaction will slow and the removal rate will slow. Also, the effect of "staining", the build up of by product absorbed into the pad surface is worsened without grooves.

It is believed that the existing polishing pads can be further improved.

SUMMARY OF THE INVENTION

Accordingly, it is an object of the present invention to provide a polishing pad for mechanical polishing, which is a further improvement of the existing polishing pads of this type. In particular, the present invention seeks to provide improvement related to the reasons 2) and 5) listed in the background section for grooving. Briefly, 2) and 5) teach that grooves enhance the transport of slurry to and from the wafer center. This invention describes a methodology for grooving which seeks to improve that transport. This invention does not address reasons 1, 3 or 4.

Additionally, it is an object of the present invention to recognize two important restrictions on the design of the grooving pattern:

1. The pitch of the grooves must be less than a lateral dimension that will be known as the "Slurry Transport Length (STL). The STL is the distance that slurry is effectively dragged across the surface of the pad at the pad/wafer interface. Naturally, the STL is a function of many factors such as the pad material, the pad roughness, the downforce used in the process, the relative velocity of the wafer and the pad and the viscosity of the slurry. However, for the conditions and materials generally used in the CMP process, the STL is less than 180 mils (0.180"). Pitches less than the STL do not significantly enhance any of the factors mentioned in 1–5, so the pitch of the grooves is free to remain constant or vary within the confines of the STL, but not exceed it.
2. Data suggests that the orientation of the grooves and the primary direction of relative motion of the wafer and the pad can neither be substantially parallel nor substantially perpendicular. Relative to reasons 2 and 5, this is probably because in the case of parallel grooves, the slurry is most likely to be transported under the wafer and then out the other side as there are inadequate transverse forces to compel it out and onto the pad surface, and in the case of perpendicular grooves, slurry is most likely spend the least residence time under the wafer, as the radial direction is the direction of maximum centrifugal force. Since in typical CMP processes using rotary tools, the tangential component of the rotation of the platen greatly exceeds the radial component of the rotation of the carrier, grooves that are predominantly concentric around a point at or near the center of the pad can be said to be primarily parallel to the direction of relative motion, and grooves that are predominantly radial from a point at or near the center of the pad can be said to be predominantly perpendicular. Therefore, a second restriction on the groove pattern is that it is neither predominantly concentric nor predominantly radial.

In keeping with these objects and with others which will become apparent hereinafter, one feature of the present invention resides, briefly stated, in a polishing pad which has a body with a working surface adapted to provide polishing of a workpiece, such as for example a wafer, wherein the working surface is provided with a singular or a plurality of grooves, and the grooves are formed so that the direction of the grooves with respect to the primary direction of the relative motion of the wafer and the pad are substantially random. In this usage, the term random is not meant to imply only disordered, but also that if we were to envision a point at the center of the wafer and consider the angles at which it impinges upon grooves, that during the course of a single revolution of the pad it would encounter grooves at almost all angles in roughly equal proportion.

When the grooves on the working surface on the pad are designed in accordance with the present invention, introduction of new slurry and evacuation of spent slurry and by-products is facilitated, particularly to and from the wafer center. Additionally, while there exist patterns that do not immediately appear to be radial and seem to provide randomness of direction such as an x-y grid pattern, such patterns still readily allow for the rapid dispersion of slurry due to centrifugal forces and are therefore not desirable. Additionally, in some cases pads can emit a noise while polishing. In the case where the grooves are primarily in one direction for a period of time (such as an x-y grid or straight parallel lines), the noise will tend to modulate in volume, creating an undesirable condition. Proper randomization of the groove direction will tend to cause the noise to be uniform in volume. Finally, closely spaced grooves which intersect (as they would in an x-y pattern) can weaken the structural integrity of the pad sufficiently so as to reduce its ability to planarize to below-acceptable levels. While this reduction of integrity has been sited as a method to engineer the pad properties (see U.S. Pat. No. 6,736,709), it generally is undesirable.

In accordance with one embodiment of the present invention, the grooves extend in substantially all directions of the plane of the working surface of the pad. The grooves can be of various widths, depths and pitches.

In accordance with still a further feature of the present invention, the working surface of the pads is subdivided into a plurality of individual portions that are space filling, and in each portion the grooves are formed by a plurality of substantially parallel lines. The lines can be of various pitch less than the STL and the grooves can be of various widths, depths and pitches.

In accordance with another embodiment of the present invention, the grooves are as a sine wave pattern on the working surface of the pad. The sine waves can be of various amplitude, wavelength and offset and the grooves can be of various widths, depths and pitches.

In accordance with still a further feature of the present invention, the working surface of the pads is subdivided into a plurality of individual portions, and in each portion the grooves are formed by a plurality of substantially concentric circles. The circles can be of various radii and the grooves can be of various widths, depths and pitches.

It is understood that the pads of this invention can be used for application of process on any of a number of substrates, such as a bare silicon wafer, a semiconductor device wafer, a magnetic memory disk or similar. The pad may be anywhere in the range of what by someone skilled in the art is considered soft (Modulus of Elasticity <1000 psi) to what is considered hard (Modulus of Elasticity >10,000 psi).

Pads of the present invention can be made by any one of a number of polymer processing methods, such as but not limited to, casting, compression, injection molding, extruding, web-coating, extruding, and sintering. The pads may be single phase or multiphase, where the second phase could include polymeric microballoons, gases or fluids. The second phase could also by an abrasive such as silica, alumina and calcium carbonate, alumina, ceria, oxides of titanium, germanium, diamond, silicon carbide or combinations thereof.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
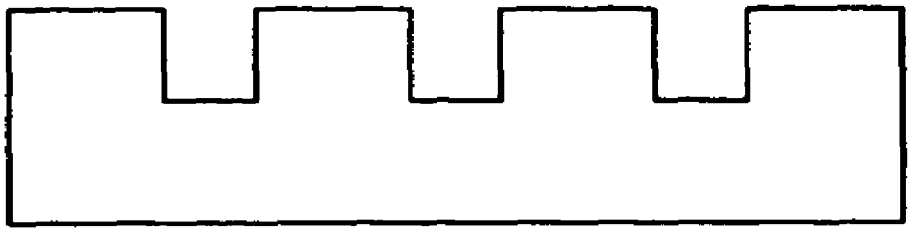
FIG. 1 is a schematic view showing a polishing pad for a chemical-mechanical polishing in accordance with the present invention in a cross-section.

A polishing pad for chemical and mechanical polishing is identified as a whole with reference numeral 1. It has a body 2 with a working surface 3. The working surface 3 is provided with a plurality of grooves as will be explained herein below.

FIG. 1 shows the cross-sectional surface of the polishing pad in accordance with an embodiment of the present invention. Here the grooves are shown of a depth approximately equal to one half the pad thickness and the cross sectional shape of the grooves as rectangular. While these represent preferred embodiments, both the depth of the grooves and their cross-sectional shapes can differ from the figure, and can vary within a given pad.

Figure 2:
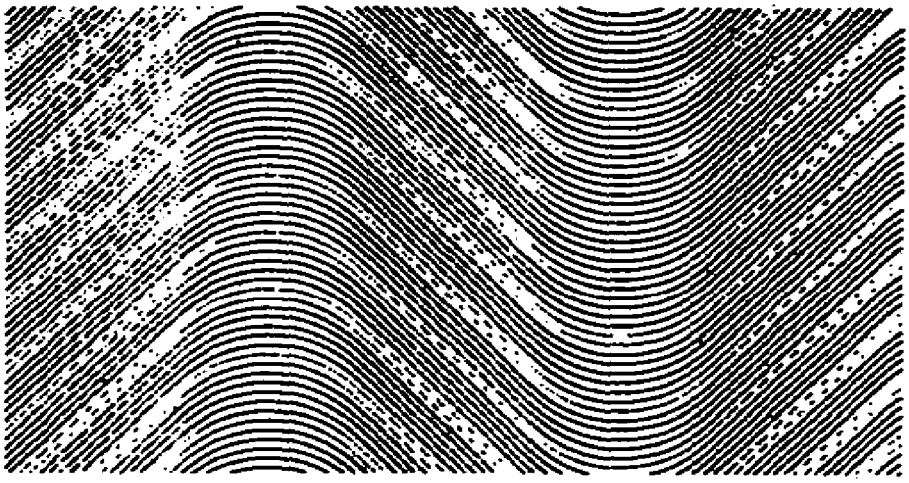
FIG. 2 is a view showing the working surface of the inventive polishing pad in accordance with one embodiment of the present invention.

FIG. 2 shows an embodiment of the present invention. Here the working surface is provided with grooves 6 which have a sinusoidal (sine-wave) pattern, and possibly a sinusoidal pattern running a cord length of the pad. The grooves 6 are located substantially parallel to one another so as to maintain a pitch less than the STL everywhere. However, they can vary in other parameters of a sine wave, such as for example amplitude, periodicity and offset, and even vary of those parameters with respect to one another as long as they everywhere in the wafer track maintain a pitch less than the STL. In the shown example the shape of the grooves is not completely of a sine wave, but rather includes alternatingly oriented semi-circles connected by straight lines. The wave-shaped grooves 6, in accordance with the present invention, are not concentric with respect to a center of the pad, but instead they span the working surface of the pad. As further variation representing the same concept, the center line of the sine wave (average position of one cycle) need not follow a straight line but could also follow any curve that is not a circle whose center is the center of the pad. These grooves can cover the majority of the pad or the significant majority of the wafer track. When the pad rotates, the grooves 6 orientation with respect to the primary direction of the relative motion between the wafer and the pad is random compared to the scale of the wafer and therefore provides the sought after highly advantageous results.

Figure 3:
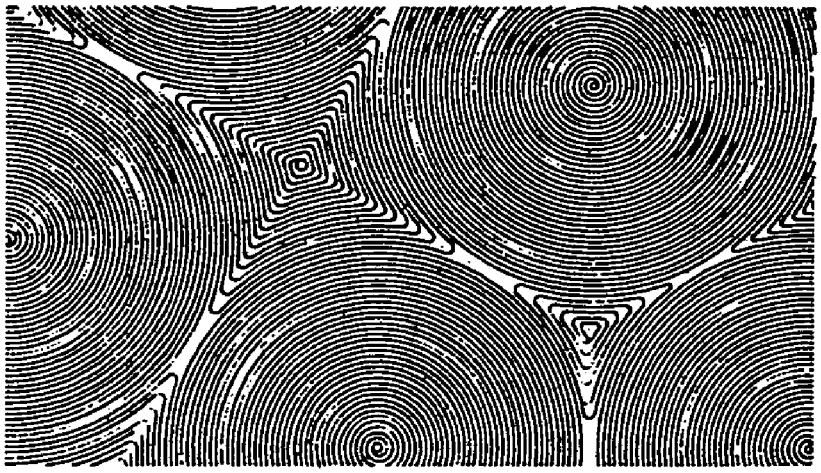
FIG. 3 is a view showing a working surface of the inventive polishing pad in accordance with another embodiment of the present invention

FIG. 3 shows the working surface of the polishing pad in accordance with another embodiment of the present invention. Here the grooves 7 have a tortoise-shell pattern similar to the pattern on a back of a tortoise. The grooves 7 include a series of concentric circles, spaced from one another, such that the boundaries of intersections make up polygonally-shaped patterns. The size of the various sets of the concentric grooves can go from small to large. The circular areas can vary in size, insignificantly. However, it is preferable when these areas are approximately equal. The pitch can vary between the circular areas and even within a circular area. In any event, all pitches should be such that a land or up area between the grooves does not exceed the STL. The circles inside the areas can be formed by a single spiral line, which is very convenient for laser grooving. Of course, the pattern can include a double spiral, etc. Other embodiments of the same concept could include circles or spirals with slight oscillations, or alternative shapes that can be made to be concentric such as squares with rounded edges, without deviating from the principle of the invention.

Figure 4:
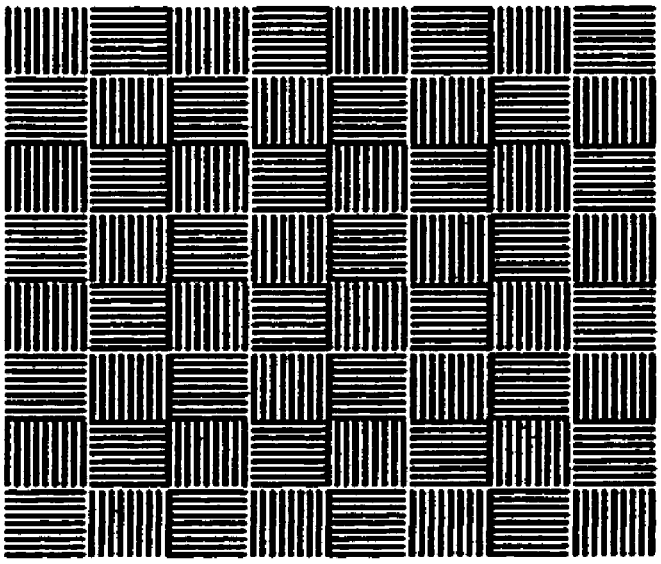
FIG. 4 is a view showing a working surface of the inventive polishing pad in accordance with a further embodiment of the present invention

FIG. 4 shows the working surface of the polishing pad in accordance with a further embodiment of the present invention. Here the grooves 8 have mosaic pattern similar to the pattern on a back of a checkerboard. The grooves 8 include a series of parallel lines filling a square shaped repeating element such that each element contains lines which are oriented perpendicular to the lines in the adjacent element. The size of the various elements can vary, but should be significantly smaller than the size of a wafer. The pitch can vary between elements and even within an element. In any event, all pitches should be less than the STL. The lines inside the elements can be formed by a single serpentine line, which is more convenient for laser grooving. Other embodiments of the same concept could include lines with slight oscillations, or alternative shapes that can be made to repeatably fill the space without deviating from the principle of the invention The grooves can be produced by laser cutting, and other suitable methods. In the pad the grooves can maintain a pitch of less than 180 mils at least everywhere inside the wafer track. The grooves can be uniformly or non-uniformly spaced apart from one another. The grooves are open at a periphery of said working surface. The grooves can be composed of a material selected from the group consisting of a polyurethane. Each of the grooves can have a width of 5 mils to 50 mils. One or more lines of the pattern are composed of grooves, holes or a combination thereof. The grooves can be machined by a laser or by mechanical means.

It will be understood that each of the elements described above, or two or more together, may also find a useful application in other types of constructions differing from the types described above.

While the invention has been illustrated and described as embodied in polishing pad, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A polishing pad consisting of a polymer sheet for a chemical mechanical polishing, comprising a body rotatable in a predetermined direction and having a working surface, said working surface being provided with grooves, said grooves being formed so as to be subdivided in a mosaic of space-filling zones, wherein the polishing pad is not formed of separate tiles of pad material.

2. A polishing pad as defined in claim 1, wherein said grooves maintain a pitch of less than 180 mils at least everywhere inside the wafer track.

3. A polishing pad according to claim 1, wherein the grooves are uniformly or non-uniformly spaced apart from one another.

4. A polishing pad as defined in claim 1, wherein said grooves are open at a periphery of said working surface.

5. A polishing pad according to claim 1, wherein said polymer sheet is composed of a material selected from the group consisting of a polyurethane, a polycarbonate, a nylon, an acrylic polymer, and a polyester.

6. A polishing pad according to claim 1, wherein one or more lines of the pattern are composed of grooves, holes or a combination thereof.

7. A polishing pad according to claim 1, wherein the grooves are machined by a laser or by mechanical means.

8. A polishing pad consisting of a polymer sheet for chemical mechanical polishing, comprising a body rotatable in a predetermined direction and having a working surface, said working surface being provided with grooves, said grooves being formed so as to be subdivided in a plurality of zones, said grooves within each of said zones being formed as substantially concentric grooves, so as to provide together a tortoise-shell shaped form.

9. A polishing pad as defined in claim 8, wherein said grooves maintain a pitch of less than 180 mils at least everywhere inside the wafer track.

10. A polishing pad according to claim 8, wherein each of the grooves are uniformly or non-uniformly spaced apart from one another.

11. A polishing pad as defined in claim 8, wherein said grooves are open at a periphery of said working surface.

12. A polishing pad according to claim 8, wherein said polymer sheet is composed of a material selected from the group consisting of a polyurethane, a polycarbonate, a nylon, an acrylic polymer, and a polyester.

13. A polishing pad according to claim 8, wherein each of the grooves has a width of 5 mils to 50 mils.

14. A polishing pad according to claim 8, wherein one or more lines of the pattern are composed of grooves, holes or a combination thereof.

15. A polishing pad according to claim 8, wherein the grooves are machined by a laser or by mechanical means.

16. A polishing pad consisting of a polymer sheet for chemical mechanical polishing, comprising a body rotatable in a predetermined direction and having a working surface, said working surface being provided with grooves, said grooves being formed so as to be subdivided in a plurality of zones, said grooves within each of said zones having a similar shape to other grooves within the same zone, and said grooves within each of said zones being configured to form a tortoise-shell pattern of grooves on said polishing pad.

17. A polishing pad comprising grooves and groups of grooves;

wherein a plurality of said grooves are positioned in a first group, and wherein each of said plurality of grooves in said first group has a shape that is similar to the rest of said plurality of grooves in said first group, and wherein each of said plurality of grooves in said first group has a common center with the rest of said plurality of grooves in said first group; and wherein said polishing pad further comprises a plurality of groups, at least some of which are similar to said first group, wherein at least one group of said plurality of groups is adjacent to another group of said plurality of groups, and wherein each group of said plurality of groups has a separate common center.

18. The polishing pad of claim 17, wherein the shapes of the groups of said plurality of groups and the positioning of said plurality of groups is configured to form a tortoise-shell pattern of grooves on said polishing pad.

* * * * *